US007990241B2

(12) United States Patent
Hernandez et al.

(10) Patent No.: US 7,990,241 B2
(45) Date of Patent: Aug. 2, 2011

(54) ENCAPSULATED SWITCHES EMPLOYING MERCURY SUBSTITUTE AND METHODS OF MANUFACTURE THEREOF

(75) Inventors: Marcos Hernandez, San Jose, CA (US); Carl Rosenblatt, Wayland, MA (US)

(73) Assignee: Thermo Fisher Scientific, Inc., Waltham, MA (US)

( * ) Notice: Subject to any disclaimer, the term of this patent is extended or adjusted under 35 U.S.C. 154(b) by 67 days.

(21) Appl. No.: 12/247,136

(22) Filed: Oct. 7, 2008

(65) Prior Publication Data

US 2009/0184788 A1 Jul. 23, 2009

Related U.S. Application Data

(60) Provisional application No. 61/022,758, filed on Jan. 22, 2008.

(51) Int. Cl.
*H01H 9/00* (2006.01)
*H01H 51/22* (2006.01)
*H01H 29/00* (2006.01)

(52) U.S. Cl. ..... 335/205; 335/78; 335/152; 200/182; 200/220

(58) Field of Classification Search ..... 335/78, 335/151, 205–207; 200/181, 182, 220, 233
See application file for complete search history.

(56) References Cited

U.S. PATENT DOCUMENTS

| | | | | |
|---|---|---|---|---|
| 1,948,687 | A | 2/1934 | Swinne | |
| 3,462,573 | A | 8/1969 | Rabinowitz et al. | |
| 5,076,051 | A * | 12/1991 | Naff | 60/203.1 |
| 5,391,846 | A | 2/1995 | Taylor et al. | |
| 5,478,978 | A | 12/1995 | Taylor et al. | |
| 5,704,958 | A | 1/1998 | Lauvray et al. | |
| 5,792,236 | A | 8/1998 | Taylor et al. | |
| 6,570,110 | B2 * | 5/2003 | Narasimhan | 200/233 |
| 2004/0055857 | A1 | 3/2004 | Narasimhan | |
| 2004/0150491 | A1 * | 8/2004 | Kondoh et al. | 333/81 R |
| 2004/0151014 | A1 * | 8/2004 | Speakman | 365/49 |
| 2004/0200704 | A1 * | 10/2004 | Fong et al. | 200/182 |
| 2007/0018761 | A1 * | 1/2007 | Yamanaka et al. | 335/78 |
| 2007/0089975 | A1 | 4/2007 | Beerling | |

FOREIGN PATENT DOCUMENTS

DE 603 821 C 10/1934

* cited by examiner

*Primary Examiner* — Anh T Mai
*Assistant Examiner* — Bernard Rojas
(74) *Attorney, Agent, or Firm* — Charles B. Katz

(57) ABSTRACT

Encapsulated switches are disclosed which substitute non-toxic gallium alloy for mercury. In one embodiment, wetting of the interior surfaces of the housing is prevented by coating the surfaces with an electrically insulative inorganic non-metallic material, such as alumina or boron nitrate. According to another embodiment, a perfluorocarbon liquid is employed as the anti-wetting agent.

14 Claims, 2 Drawing Sheets

ENCAPSULATED SWITCHES EMPLOYING MERCURY SUBSTITUTE AND METHODS OF MANUFACTURE THEREOF

CROSS-REFERENCE TO RELATED APPLICATION

This application claims the priority benefit under 35 U.S.C. §119(e) of U.S. provisional patent application 61/022,758 for "Replacement of Mercury Switches with Switches Made of Non-Toxic Materials", filed Jan. 22, 2008, the entire disclosure of which is incorporated herein by reference.

FIELD OF THE INVENTION

The present invention relates generally to electrical switches, and more particularly to encapsulated liquid metal switches and methods of manufacture thereof.

BACKGROUND OF THE INVENTION

Mercury-based electrical switches have been used historically in a wide variety of settings, including electronics, automotive, aerospace, military and industrial applications. Generally described, such switches utilize a pool of mercury contained in a sealed housing to selectively establish or facilitate the establishment of a conductive path between electrodes. In one illustrative example, referred to as a "tilt switch", the mercury pool is caused to occupy different spaces within the interior volume of the housing depending on the gravitational orientation of the housing. When the housing is placed in one orientation (e.g., upright), the mercury pool contacts two or more electrodes to allow the flow of current there between; when the housing is placed in a different orientation, the mercury pool is no longer in contact with both electrodes, and thus the circuit is opened. Mercury possesses several properties that make it an ideal material for switches of this type, including melting and boiling points that allow it to remain in the liquid phase over a wide range of operating temperatures, low resistivity, and low wettability with respect to glass and other commonly employed housing materials.

Growing concerns about mercury's toxicity and the effect of its release to the environment have prompted adoption of governmental regulations that favor or require the phase-out of mercury switches in commercial products. To date, however, no wholly satisfactory replacement devices have been developed. One approach that has been extensively investigated involves substituting a gallium based alloy (e.g., a gallium-indium-tin eutectic) for mercury in an encapsulated switch. Such gallium alloys are liquid over a typical range of switch operating temperatures and exhibit low resistivity. A major obstacle to the substitution of mercury with gallium alloy is that gallium alloys, unlike mercury, tend to wet glass and other housing materials. This wetting of housing surfaces may create persistent electrical pathways that are not opened (or are opened very slowly) when the switch is placed in the "off" position, thereby rendering the switch partially or fully inoperative.

Various solutions to the problem of wetting of housing surfaces by a gallium alloy have been proposed in the prior art. U.S. Pat. No. 5,704,958 to Lauvray et al. prescribes treating glass with a silyling agent such as trimethylchlorosilane to alter Si—OH bonds at the glass surface and thereby render them inactive towards gallium and its alloys. U.S. Pat. No. 5,391,846 to Taylor et al. teaches that wetting can be reduced or eliminated by coating the housing surfaces with a layer of a fluoropolymer material. U.S. Pat. No. 5,792,236, also to Taylor et al., attributes wetting of housing surfaces to oxidation of the gallium alloy, and suggests pretreating the gallium alloy or its constituents to remove oxides prior to introducing the gallium alloy into the housing.

The foregoing and other techniques, while purportedly successful at reducing or eliminating wetting of housing surfaces, may not be suitable for use with conventional encapsulated switch manufacturing techniques. For example, a common switch manufacturing process involves heating a glass housing to its softening point to seal the housing to the electrode assembly. This could cause melting or decomposition of certain coatings used in the prior art to reduce wetting, such as the fluoropolymer material proposed in the aforementioned U.S. Pat. No. 5,391,846 to Taylor et al. Others of the techniques advanced in the prior art may not be appropriate for use with different housing materials (polymers, glasses, ceramics or metals), or may render the manufacturing process significantly more complex and costly.

SUMMARY

An encapsulated switch constructed in accordance with an embodiment of the invention includes a housing having an interior volume, a pool of gallium alloy liquid located within the interior volume, and at least first and second electrodes. The pool of gallium alloy liquid acts to controllably establish or facilitate the establishment of a conductive pathway between the electrodes. To prevent wetting by the gallium alloy liquid, contactable surfaces of the housing are coated with a layer of an electrically insulative inorganic non-metallic material, such as alumina or boron nitrate. Coating materials of this description are generally heat-resistant and are able to withstand the elevated temperatures to which they may be subjected during a conventional manufacturing process, e.g., during heating of a glass housing to its softening point to seal the electrodes to the housing.

According to an alternative embodiment, wetting of the housing by the gallium alloy liquid may be eliminated by applying a layer of a perfluorocarbon liquid to the contactable surfaces of the housing.

Per another aspect of the invention, a method for manufacturing an encapsulated switch is provided that includes steps of preparing the interior surfaces of the housing by applying a coating of a layer of an electrically insulative inorganic non-metallic or perfluorocarbon material, adding a quantity of gallium alloy liquid to the housing, and then sealing the housing to an electrode assembly such that the electrodes extend into the housing interior.

The apparatus and method embraced by the present invention enables the manufacture of encapsulated switches utilizing non-toxic materials that possess performance characteristics similar to conventional mercury-based encapsulated switches.

DETAILED DESCRIPTION OF EMBODIMENTS

Certain embodiments of the present invention are described below. It should be noted that these embodiments are intended as illustrative rather than limiting, and that aspects of the invention may be beneficially employed in connection with any number of switches or analogous devices. As used herein, the term "switch" means any device capable of selectively establishing an electrical pathway between conductors, and is specifically intended to include within its scope relays or other structures in which the switch state is controlled via another electrical circuit.

Figure 1A:
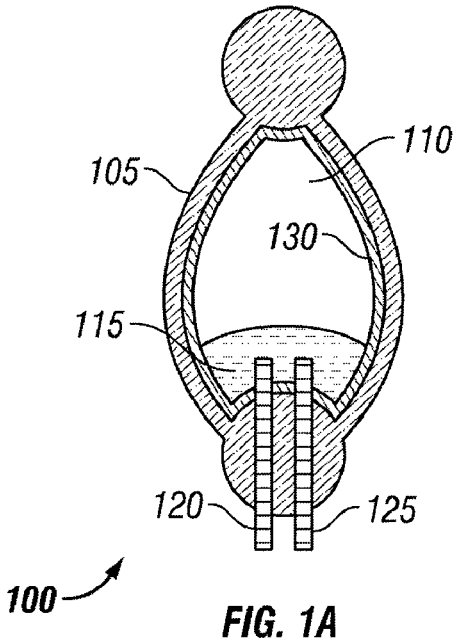
FIGS. 1A and 1B respectively depict, in "on" and "off" orientations, cross-sectional views of a tilt switch constructed according to an embodiment of the invention.
Figure 1B:
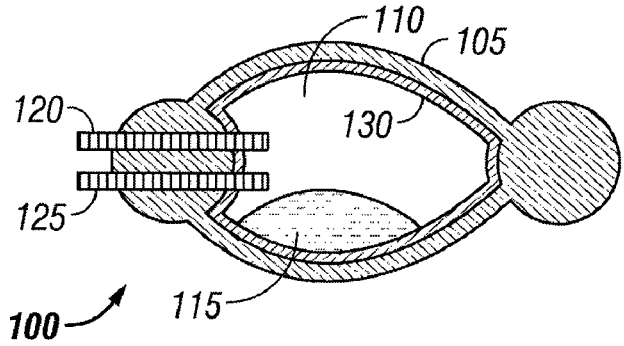

FIGS. 1A and 1B depict in rough cross-sectional view a tilt switch 100 constructed in accordance with an embodiment of the invention. As discussed further herein below, tilt switch 100 is shown in its "on" orientation in FIG. 1A and in its "off" orientation in FIG. 1B. Tilt switch 100 includes a housing 105 that defines a sealed interior volume 110 containing a quantity of a gallium alloy liquid, referred to as the gallium alloy pool 115. Housing 105 will typically be formed from an electrically insulative material, such as a glass or ceramic, but conductive materials such as metals may be used for certain implementations. Housing 105 may be of unitary construction, or may instead be formed from multiple components that are joined or otherwise attached during the manufacturing process.

Gallium alloy pool 115 constitutes an electrically conductive liquid that establishes or breaks an electrical pathway between electrodes 120 and 125 depending on the space it occupies within interior volume 110. In FIG. 1A, switch 100 is depicted in its upright "on" position, wherein gallium alloy pool 115 occupies a space within interior volume 110 that bridges electrodes 120 and 125 and allows current to flow therebetween. In a typical implementation, the gallium alloy is composed of gallium and indium, with optional components of tin, zinc, silver and/or lead. Such alloys are used for various commercial applications, and sources of gallium-indium-tin alloys include Geratherm Medical AG of Geschwenda, Germany, which sells an alloy having the trade name Galinstan, and Indium Corporation of Utica, N.Y., which sells a gallium-indium alloys under the trade name Indalloy 46L. The Galinstan and Indalloy 46L alloys have melting points in the range of −19°-7° C. and are thus in the liquid phase at typical operating temperatures for most applications for which mercury-based switches have been historically utilized. While the Galinstan and Indalloy 46L alloys are cited as illustrative examples, it should be noted that the present invention should not be construed as being limited to use with any particular gallium alloy composition.

Electrodes 120 and 125, fabricated from a suitable electrically conductive material or combination of materials, penetrate housing 105 and extend into the interior volume 110 thereof. The electrodes are sealed to adjacent areas of housing 105 such that interior volume 110 is closed off from the surrounding environment in order to prevent leaking of gallium alloy pool 115 as well as the ingress of ambient oxygen and/or other gases that react with switch materials and degrade performance. Typically, interior volume 110 is filled with a non-reactive gas. Alternatively, interior volume 110 may be evacuated during manufacture such that it is maintained at a vacuum.

Figure 2A:
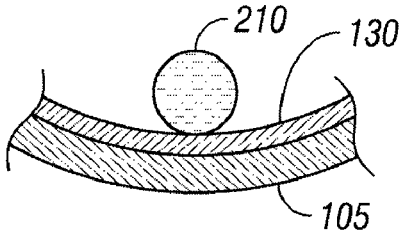
FIG. 2A depicts in fragmentary view a portion of the tilt switch housing having a coating applied thereto to eliminate wetting of the housing by gallium alloy liquid.
Figure 2B:
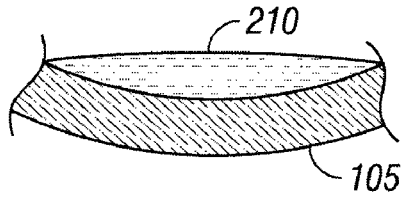
FIG. 2B depicts wetting of the housing surface by gallium alloy liquid in the absence of the coating.

As discussed in the background section, gallium alloys have the undesirable property of wetting glass and other commonly-used switch housing materials. To avoid wetting of the housing interior surfaces and its attendant problems, all surfaces of housing 105 contactable by gallium alloy pool 115 are coated with a layer 130 of a material selected for its non-wettability by gallium alloy. The present invention embraces two sets of materials that satisfy the non-wettability requirement: electrically insulative inorganic nonmetallic materials such as alumina and boron nitrate, and perfluorocarbon liquids. Referring to FIG. 2A, which depicts in fragmentary view a portion of housing 105, a layer 130 of one of the foregoing materials overlies the interior surface of housing 105. Methods for applying layer 130 during switch manufacture will be discussed below in connection with FIG. 4. Due to the non-wettability, a quantity of gallium alloy 210 forms a compact droplet that contacts layer 205 over a relatively small area. The attractive force between the gallium alloy 210 and layer 130 is low, allowing the gallium alloy to be easily dislodged from the housing surface and caused to occupy a different region within interior volume, e.g., by action of the gravitational force applied by changing the orientation of switch 100 to the "off" position, as depicted in FIG. 1B. Conversely, in the absence of a anti-wetting coating, gallium alloy 210 spreads out on the surface of housing 105 as depicted in FIG. 2B due to the relatively greater attractive force between the housing 105 material and the gallium alloy, and the gallium alloy may continue to adhere to housing 105 even when the switch orientation is changed or other forces are applied. As discussed above, this behavior is undesirable, since it may result in persistent conductive pathways being established and current continuing to flow between electrodes 120 when switch 105 is moved to the "off" position.

Figure 3A:
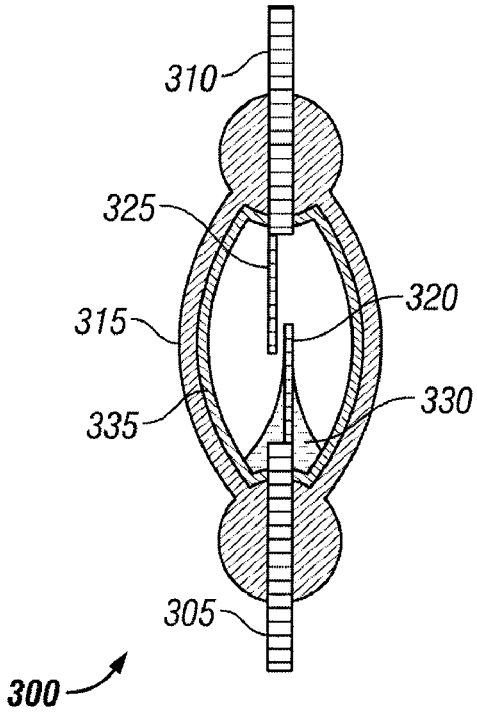
FIGS. 3A and 3B respectively depict, in "on" and "off" states, cross-sectional views of a wetted reed switch constructed in accordance with an embodiment of the invention.
Figure 3B:
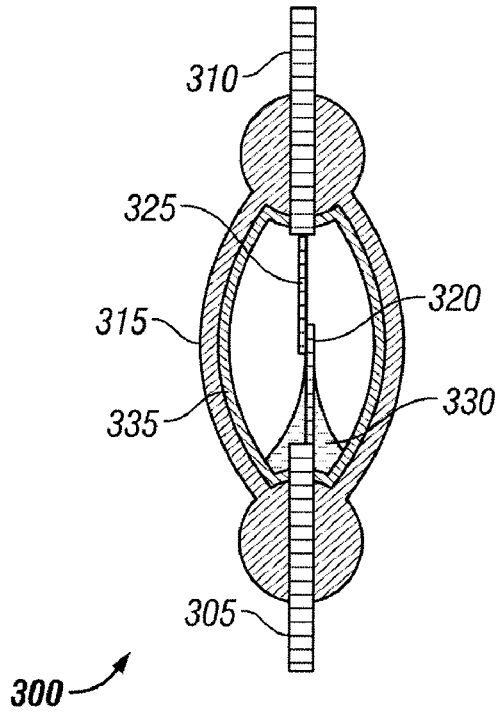

FIGS. 3A and 3B illustrate a wetted reed switch 300 constructed in accordance with another embodiment of the present invention. Wetted reed switch 300 includes electrodes 305 and 310 that penetrate housing 315 and terminate in magnetizable reeds 320 and 325. The end or contact portions of reeds 320 and 325 are separated by a gap when switch 300 is the off state, as illustrated in FIG. 3A, such that no current flows between electrodes 305 and 310. In the presence of a magnetic field, which may be established by bringing a permanent magnet in proximity with switch 300 or by supplying current to a magnetic coil positioned adjacent to switch 300, reeds 320 and 325 are brought into contact to create a conductive pathway between electrodes 305 and 310, as depicted in FIG. 3B.

Housing 315 contains a pool of gallium alloy liquid 330, which is drawn up electrode 305 by capillary action and wets the end portions of reeds 320 and 325. The presence of gallium alloy on the reed end portions lowers the resistance path for contact closure and damps out contact bounce or chatter, thereby providing consistent and predictable resistance over wide ranges of temperature and contact load current. In order to prevent problems arising from the wetting of the interior surfaces of housing 315 by gallium liquid pool 330 (e.g., establishment of an unintended conduction path between electrodes 305 and 310), a layer 335 of an anti-wetting agent is applied to the housing interior surfaces. As discussed above in connection with the tilt switch embodiment, the anti-wetting agent may take the form of an insulative inorganic nonmetallic material such as alumina or boron nitrate, or a perfluorocarbon liquid. The interior volume of housing 315 is preferably evacuated or filled with a non-reactive gas during manufacture to avoid problems arising from reaction of the switch materials with oxygen.

Another example (offered by way of illustration rather than limitation) of an encapsulated switches that may be constructed in accordance with embodiments of the invention is a displacement relay, or plunger switch, in which the gallium alloy is displaced within the interior of the switch housing by action of an electromagnetically actuated plunger mechanism. In substantially the same manner as described above, the interior housing surfaces of such a switch are coated with a layer of an insulative inorganic nonmetallic material such as alumina or boron nitrate, or a perfluorocarbon liquid, in order to prevent wetting of the housing surfaces by the gallium alloy liquid.

Figure 4:
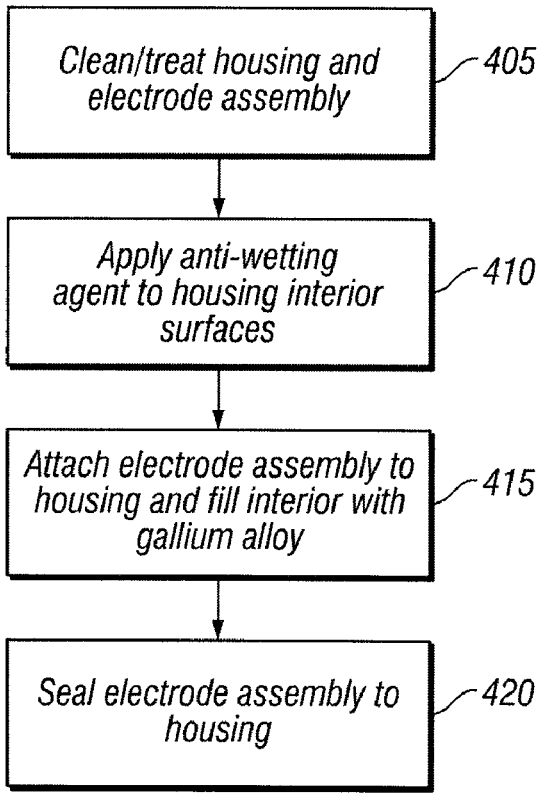
FIG. 4 is a flowchart depicting the steps of a method for manufacturing an encapsulated switch.

FIG. 4 is a flowchart depicting steps of a method for manufacturing an encapsulated switch according to an embodiment of the invention. In step 405, the switch housing, for example housing 105 of switch 100 depicted in FIG. 1, and the electrode assembly, comprising for example electrodes 120 and 125, are cleaned and treated to remove contaminants and prevent the formation of oxides. Cleaning and treatment of the housing and electrode assembly may involve washing with a concentrated acid such as hydrochloric acid (HCl). However, the presence of residual HCl or other acid in a manufactured switch may degrade its performance, for example through the formation of high-resistivity gallium/indium chloride salts. In order to avoid problems of this nature, all of the HCl or other acid should be removed from the switch components prior to final assembly, which may be accomplished by performing a subsequent wash of the components with a suitable liquid such as Fluorinert, a line of perfluorcarbon liquids available from the 3M Company (Maplewood, Minn.).

Next, in step 410, an anti-wetting agent is applied to the interior surfaces of the switch housing, i.e., those surfaces contactable by the gallium alloy. The method of application of the anti-wetting agent will depend on the selection of the coating material. For electrically insulative inorganic nonmetallic materials, the interior surfaces may be coated by applying a paint comprising a suspension of inorganic nonmetallic material (e.g., alumina or boron nitrate particles) in water or other liquid carrier, and then evaporating the carrier to form the coating. Paints of this type are commercially available from Aremco Products, Inc. (Valley Cottage, N.Y.). Other techniques that may be suitable for the application of an inorganic nonmetallic coating include (without limitation) sputtering, physical vapor deposition and chemical vapor deposition.

If a perfluorocarbon liquid is employed for the anti-wetting agent, application to the interior housing surfaces may be simply performed by washing the inside of the housing with an appropriate quantity of the perfluorocarbon liquid to leave a residual film layer that overlies the housing surfaces. Various formulations of perfluorocarbon liquids are commercially available, such as the aforementioned family of Fluorinert liquids sold by the 3M Company. A preferred perfluorocarbon formulation for this application is FC-40 Fluorinert liquid, which is a mixture of perfluoro compounds primarily having twelve carbon atoms. Generally, such perfluorocarbon liquids are electrically insulative, chemically inert, and remain in the liquid phase at typical switch operating temperatures. As noted above, Fluorinert or other perfluorocarbon liquids may also be utilized to remove HCl from switch components, so the perfluorocarbon wash may serve dual functions of HCl removal and anti-wetting coating application.

Following application of the anti-wetting agent to interior surfaces of the housing, the electrode assembly is attached to the housing to form the switch, and an appropriate quantity of gallium alloy liquid is added to the internal volume of the switch, step 415. The quantity of gallium alloy liquid added to the switch will depend on the switch's configuration and dimensions. In certain implementations, the gallium alloy liquid may be treated with HCl or other substance prior to injection into the switch in order to react with any oxides that have formed. As noted above, however, the presence of residual acid within the switch interior may be harmful to performance, so the acid should be removed prior to depositing the gallium alloy liquid in the switch interior.

The attachment/gallium alloy liquid addition step 415 is preferably performed in a controlled manufacturing environment to prevent oxygen or other reactive gases from occupying the interior volume of the switch. In one implementation, the interior volume is evacuated during step 415 to generate a vacuum therewithin. In another implementation, the switch interior is filled with a non-reactive gas such as nitrogen, hydrogen (for high-voltage applications), or helium.

Finally, in step 420, the electrode assembly is sealed to the housing to close off the switch interior volume from the surrounding environment. As discussed above, this step may involve, in the case of a glass housing, heating the housing or portions thereof to the material softening point to cause to glass to flow into and occupy any gaps between the housing and electrodes.

It is understood that the manufacturing method presented in FIG. 4 and described above is highly generalized, and that the method may be adapted to specific switch designs and requirements by incorporating additional steps, breaking individual steps into component sub-parts, or by reordering the sequence of steps.

It is further understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An encapsulated switch, comprising:

a housing defining an interior volume;

a pool of a gallium alloy liquid located within the interior volume;

first and second electrodes located within the interior volume, the pool of gallium alloy liquid establishing or assisting to establish an electrical conduction path between the first and second electrodes when the switch is in an on state; and a layer of an anti-wetting agent overlying at least a portion of the interior surface of the housing to prevent wetting thereof by the gallium alloy liquid, the anti-wetting agent comprising an electrically insulative inorganic non-metallic material.

2. The encapsulated switch of claim 1, wherein the electrically insulative inorganic non-metallic material comprises boron nitrate.

3. The encapsulated switch of claim 1, wherein the electrically insulative inorganic non-metallic material comprises alumina.

4. The encapsulated switch of claim 1, wherein the gallium alloy liquid comprises a gallium-indium alloy.

5. The encapsulated switch of claim 1, wherein the first and second electrodes comprise first and second reeds, the first and second reeds being normally separated and being movable into contact in the presence of a magnetic field.

6. The encapsulated switch of claim 1, wherein the pool of the gallium alloy liquid is displaceable between a first position in which no electrical conduction path exists between the first and second electrodes and a second position in which the pool forms the electrical conduction path.

7. The encapsulated switch of claim 6, wherein during operation of the switch, the pool of gallium alloy liquid is displaced between first and second positions by changing the gravitational orientation of the switch.

8. The encapsulated switch of claim 1, wherein at least a portion of the housing is fabricated from a glass material.

9. An encapsulated switch, comprising:

a housing defining an interior volume;

a pool of a gallium alloy liquid located within the interior volume;

first and second electrodes located within the interior volume, the gallium alloy liquid establishing or assisting to establish an electrical conduction path between the first and second electrodes when the switch is in an on state;

a layer of an anti-wetting agent overlying at least a portion of the interior surface of the housing to prevent wetting thereof by the gallium alloy liquid, the anti-wetting agent comprising perfluorocarbon liquid.

10. The encapsulated switch of claim 9, wherein the gallium alloy liquid comprises a gallium-indium alloy.

11. The encapsulated switch of claim 9, wherein the first and second electrodes comprise first and second reeds, the first and second reeds being normally separated and being movable into contact in the presence of a magnetic field.

12. The encapsulated switch of claim 9, wherein the pool of the gallium alloy liquid is displaceable between a first position in which no electrical conduction path exists between the first and second electrodes and a second position in which the pool forms the electrical conduction path.

13. The encapsulated switch of claim 12, wherein during operation of the switch, the pool of gallium alloy liquid is displaced between first and second positions by changing the gravitational orientation of the switch.

14. The encapsulated switch of claim 9, wherein at least a portion of the housing is fabricated from a glass material.

* * * * *